US005740648A

United States Patent [19]

Piccone

[11] Patent Number: 5,740,648

[45] Date of Patent: Apr. 21, 1998

[54] MODULAR FORMWORK FOR CONCRETE

[76] Inventor: Francesco Piccone, 5076 Connaught Drive, Vancouver, Canada, V6M 3G1

[21] Appl. No.: 648,210

[22] Filed: May 14, 1996

[51] Int. Cl.[6] ..... E04B 2/26; F04B 2/32

[52] U.S. Cl. ..... 52/426; 52/275; 52/562; 52/563; 249/47; 249/191; 249/213; 249/216

[58] Field of Search ..... 52/272, 275, 563, 52/564, 562, 426; 249/213, 216, 194, 191, 192, 38, 47, 36

[56] References Cited

U.S. PATENT DOCUMENTS

| | | | |
|---|---|---|---|
| 2,050,258 | 8/1936 | Bemis . | |
| 2,172,052 | 9/1939 | Robbins . | |
| 3,288,427 | 11/1966 | Pluckebaum | 249/47 |
| 3,788,020 | 1/1974 | Gregori . | |
| 4,276,730 | 7/1981 | Lewis . | |
| 4,532,745 | 8/1985 | Kinard . | |
| 4,731,964 | 3/1988 | Phillips . | |
| 4,742,665 | 5/1988 | Baierl . | |
| 5,216,863 | 6/1993 | Nessa et al. . | |
| 5,311,718 | 5/1994 | Trousilek | 52/425 |
| 5,491,947 | 2/1996 | Kim | 52/426 |
| 5,553,430 | 9/1996 | Majnaric et al. | 52/426 X |

FOREIGN PATENT DOCUMENTS

| | | |
|---|---|---|
| 957816 | 11/1974 | Canada . |
| 507787 | 9/1920 | France . |
| 1381945 | 2/1963 | France . |
| 8204088 | 11/1982 | WIPO . |
| 9500724 | 1/1995 | WIPO . |

*Primary Examiner*—Wynn E. Wood
*Assistant Examiner*—Timothy B. Kang
*Attorney, Agent, or Firm*—Galgano & Burke

[57] ABSTRACT

A modular assembly for creating formwork for casting vertical concrete structures is characterized by elongated elements having a generally concave interior surface which are disposed in edge to edge relationship in two facing rows, and which are simultaneously retained in edge to edge relationship and in facing relationship by connecting members. The connecting members comprise an elongated wall with a central portion between two outer portions. The elements have two extensions which extend laterally along the plane of the middle side of the elements. By engaging a connecting member to an element, the outer side of the element, the extension of the element and the outer portion of the connecting member form a triangular space providing structural rigidity to the formwork.

9 Claims, 5 Drawing Sheets

MODULAR FORMWORK FOR CONCRETE

TECHNICAL FIELD OF THE INVENTION

This invention relates to formwork for casting vertical concrete structures such as walls.

The forms of the invention are elongated modular elements which are adapted to interconnect to one another along their longitudinal sides to create overall formwork for casting concrete to form a wall or other vertical structure.

BACKGROUND ART

It is known in the prior an to provide modular form elements which may be stacked end to end and wherein a plurality of horizontal courses are superposed one upon the other to create a wall of formwork. Examples of such elements are disclosed in U.S. Pat. No. 2,172,052 to Robbins and U.S. Pat. No. 3,788,020 to Gregori.

It is also known to provide modular form elements consisting of a plurality of vertical and essentially closed forms which can be nested alongside one another to create a series of adjacent concrete columns. U.S. Pat. No. 5,216,863 to Nessa et al. discloses such elements having generally circular or octagonal cross sections. In Nessa's octagonal cross section embodiment, the cross section of the form element comprises the general shape of an octagon with one side missing so as to create an open side. The free edges adjacent the open side are provided with retaining means which are designed to cooperate with complementary retaining means mounted on the back of an adjacent element. A plurality of elements can thereby be secured to one another, "piggyback" style, to create a formwork of columns into which concrete can be poured.

There are a number of desirable objectives in relation to modular form elements. Where it is intended to leave the form in place after casting the concrete, it is desirable to provide a forth element which enables the easy application of wall finishes or coverings to the surface thereof. Other desirable features are the ability to allow the concrete to flow between interconnected form elements so as to provide strength and rigidity to the concrete structure, the ability to insert reinforcing rods in the formwork and the ability of the formwork to be waterproof so as to prevent corrosion of reinforcing elements embedded in the concrete. It is also desirable in some cases for finished formwork to offer insulation properties.

Various prior art approaches achieve some of these objectives, but with varying success. For example, in the case of U.S. Pat. No. 5,216,863 it is difficult to provide insulation or liner within the form, mainly because of the essentially closed nature of the octagonal or circular form, and the structure of the form tends to impede the flow of concrete between adjacent forms. Moreover, the resulting formwork lacks structural rigidity and when the formwork is filled with concrete, it suffers from a 'banana effect' which causes the walls of the form elements to bulge out. This lack of rigidity in the formwork makes it difficult to secure wall finishes and coverings.

It is an object of this invention to provide a modular formwork assembly which overcomes the deficiencies of the prior art and which has improved structural rigidity when assembled so as to minimize bulging or a "banana effect" in the structure.

SUMMARY OF THE INVENTION

According to one of its aspects, the invention comprises a modular formwork assembly for casting concrete to form vertical structures. The assembly comprises an elongated element having a surface extending from one longitudinal edge of the element to the opposite longitudinal edge of the element so as to define a generally concave cross section. The surface has a generally planar middle portion. The element also comprises two extensions which extend laterally outward from the middle portion and which are co-planar with the middle portion. The longitudinal edges and the edges of the extensions are provided with engaging means extending substantially along the length of the element for releasably interconnecting the element with a connecting member. An elongated connecting member comprises an elongated wall defined between a first and an opposite longitudinal edges of the member, a central portion defined between a first and an opposite inner longitudinal section lines of the member, two outer portions each of which is defined between a longitudinal edge and an inner longitudinal section line of the member. Each of the longitudinal edges and inner longitudinal section lines of the member is provided with engaging means adapted to cooperate in longitudinal sliding engagement with the engaging means of each of a pair of said elements when the elements are presented in edge to edge relationship for connection about opposing sides of the engaging means of the member. The connecting member is adapted to engage simultaneously each of a first pair of elements presented in edge to edge relationship about one outer portion of the member and each of a second pair of elements presented in edge to edge relationship about the opposite outer portion of the member.

The resulting assembly provides a formwork which substantially maintains its shape when filled with concrete and which does not suffer from "banana effect". The spacing of ribs along the central portion of the connecting member provides pathways for the insertion into the formwork of reinforcing rods, and also allows the integral formation of horizontal lengths of concrete along the pathways formed by aligned spaces between the ribs of adjacent elements.

By engaging a connecting member to an element, a triangular space is formed between the outer side of the element, the extension of the element and the outer portion of the connecting member. The triangular space provides increased rigidity to the formwork and serves as an insulator for the formwork wall.

BRIEF DESCRIPTION OF THE DRAWINGS EMBODIMENT

Other aspects of the invention will be evident from the following disclosure and description of the preferred embodiment and from the drawings in which.

DETAILED DESCRIPTION OF THE BEST MODE AND PREFERRED EMBODIMENT OF THE INVENTION

Embodiment of the Invention

Figure 1:
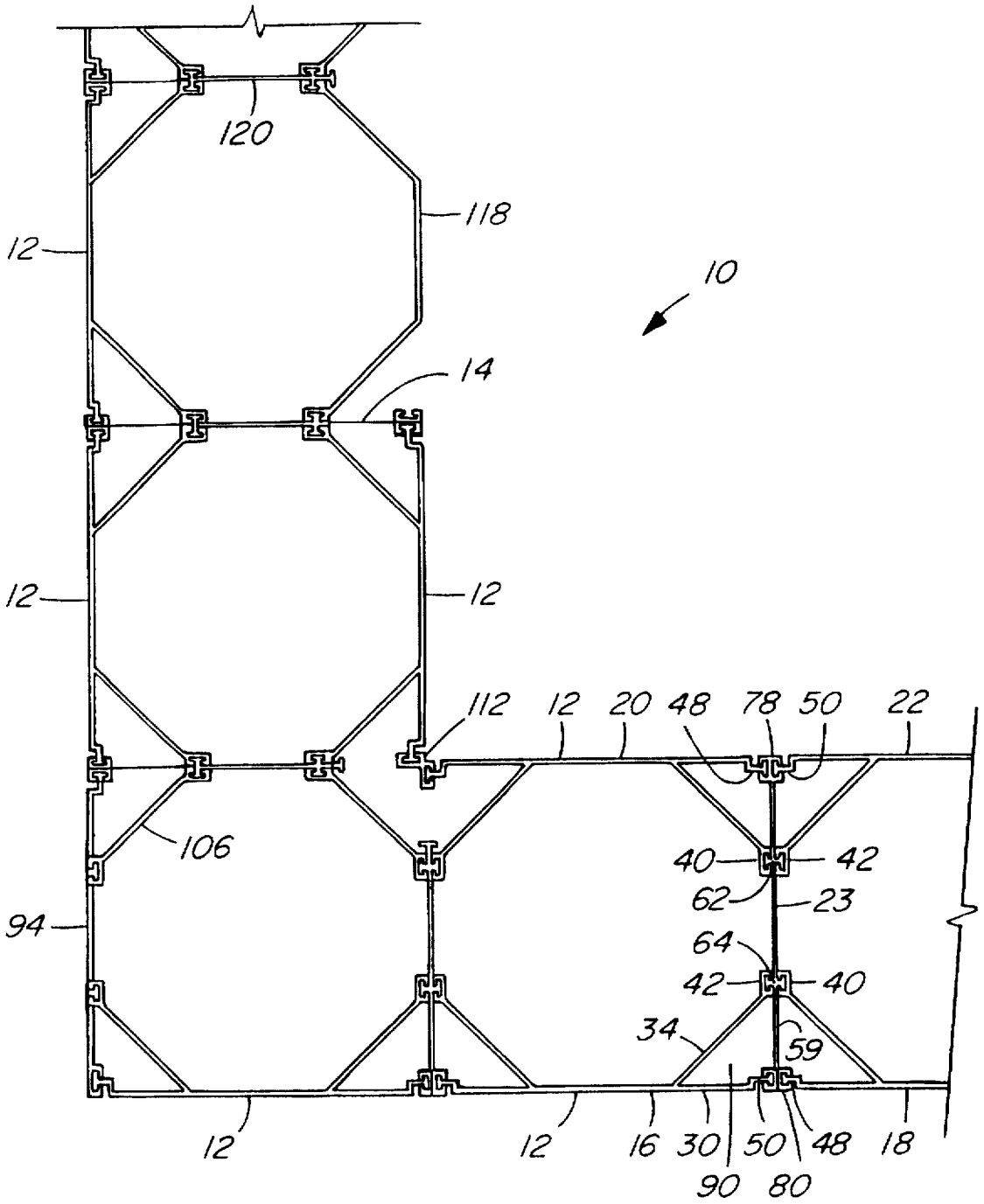
FIG. 1 is a schematic plan view of an assembly of formwork illustrating connecting members and elements according to the invention.

FIG. 1 is a schematic plan view of an assembly 10 of formwork illustrating a plurality of elements 12 joined together by connecting members 14. A formwork wall is created by placing a course of elements adjacent one another in edge to edge relationship, as between elements 16 and 18, placing a second course of elements adjacent one another in edge to edge relationship, as between elements 20 and 22, and inter-connecting the elements by means of a connecting member, as in member 23.

Figure 2:
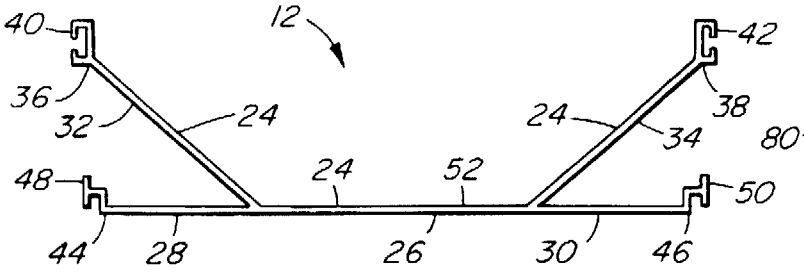
FIG. 2 is an end view of an element according to the preferred embodiment of the invention.

FIG. 2 is an end view of an element 12 according to the preferred embodiment of the invention. The element 12 is preferably made of a material such as polyvinylchloride as are the other components described herein. The element 12 is comprised of a generally concave elongated form and has a surface 24 which is three sided. The middle side or portion 26 of the element 12 is provided with two extensions 28 and 30 which extend laterally along the plane of the middle side 26. The longitudinal edges 36 and 38 of the outer sides 32 and 34 are provided with engaging means 40 and 42. The engaging means 40 and 42 of the outer sides 32 and 34 are in the shape of the female portion of a T connector. The longitudinal edges 44 and 46 of the extensions 28 and 30 are also provided with engaging means 48 and 50. The engaging means 48 and 50 of the extensions 28 and 30 are in the shape of the male portion of a T connector.

The concavity of the element 12 allows easy access to the inside face 52 of the element for the placing or bonding of various types of insulation or liner within the inside face of the element prior to erection of the formwork or at the time of manufacture of the element 12. Foam type insulation may be used or a composite insulation or a thinner liner may be bonded to the inner surface of the element 12. Alternatively, the element 12 can be used without any insulation or liner.

Figure 3:
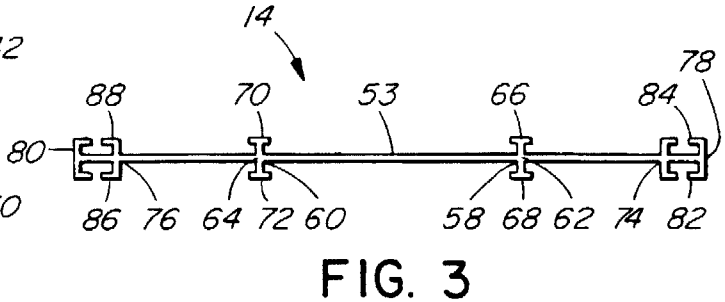
FIG. 3 is an end view of one embodiment of a connecting member according to the invention.
Figure 4:
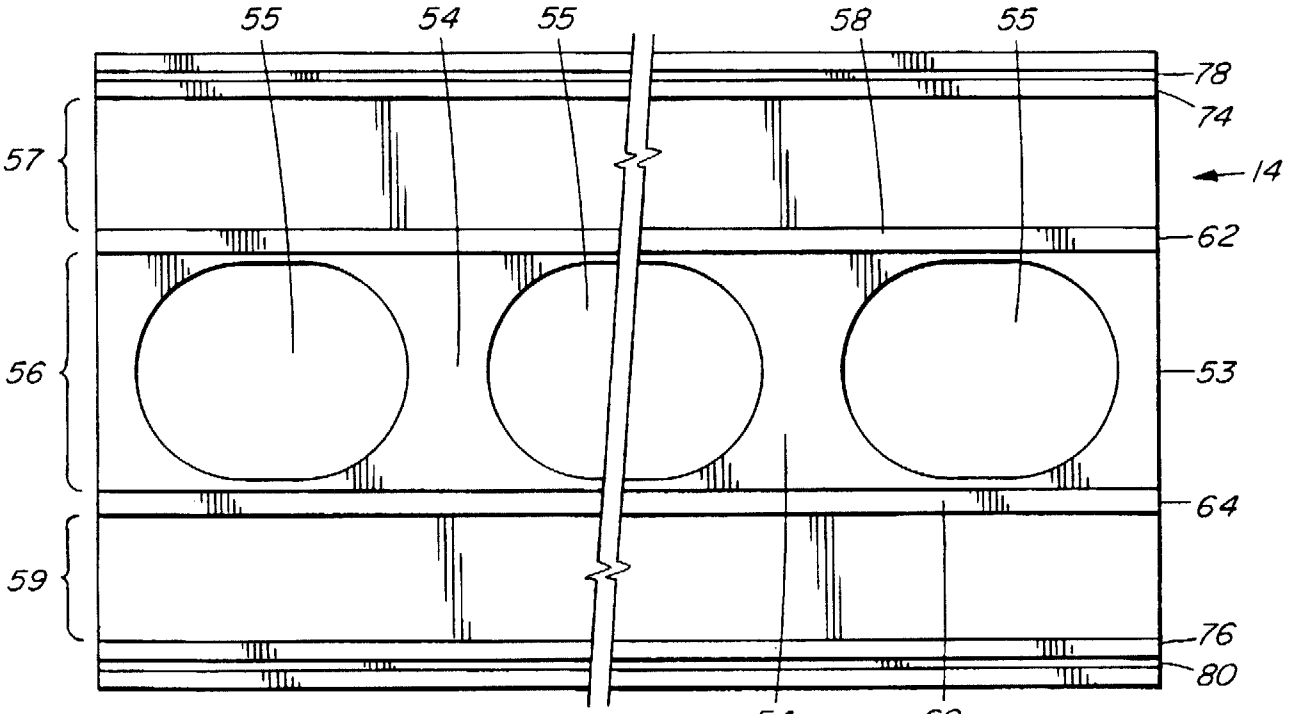
FIG. 4 is a front view of a length of the connecting member shown in FIG. 3.

One embodiment of a connecting member 14 according to the invention is illustrated in FIGS. 3 and 4. The connecting member 14 comprises an elongated wall 53 with a central portion 56 between two outer portions 57 and 59. A series of ribs 54 extend in the central portion 56 along the length of the connecting member between the inner longitudinal section lines 58 and 60. A series of spaces 55 is formed between the ribs 54 of the central portion 56. Engaging means 62 and 64 are provided along each inner line 58 and 60 of the connecting member 14. Engaging means 62 in turn consists of two male portions 66 and 68 of a T connector disposed opposite one another in relation to the central portion 56. Engaging means 64 in turn consists of two male portions 70 and 72 of a T connector disposed opposite one another in relation to the central portion 56. The outer longitudinal edges 74 and 76 of the connecting member 14 are also provided with engaging means 78 and 80. Engaging means 78 in turn consists of two female portions 82 and 84 of a T connector disposed opposite one another in relation to the central portion 56. Engaging means 80 in turn consists of two female portions 86 and 88 of a T connector disposed opposite one another in relation to the central portion 56.

Each of the male portions of the T connector that form the inner line engaging means 62 and 64 of the connecting member 14 are sized to cooperate with the female portions of the T connector which form the outer side engaging means 40 and 42 of the element 12. Each of the female portions of the T connector that form the outer edge engaging means 78 and 80 of the connecting member 14 are sized to cooperate with the male portions of the T connector which form the extension engaging means 48 and 50 of the element 12.

Referring again to FIG. 1, the engaging means 62, 64, 78 and 80 of connecting member 23 can be positioned in relation to engaging means 40, 42, 48 and 50 of four elements 16, 18, 20 and 22, then slid into engagement with them along the length of the connecting member 23 and of the elements 16, 18, 20, 22 (i.e. into the plane of FIG. 1). Connecting member 23 thereby acts as a spacer to hold elements 16 and 20 and elements 18 and 22 a controlled distance apart from one another. This, as well as the fact that the concrete can flow laterally through the spaces 55 of the connecting members, prevents the bulging outward of the interconnected elements once the concrete is poured into the formwork.

It will be appreciated that the connecting member 23 acts not only to hold the facing elements 16 and 20 and elements 18 and 22 a certain distance from one another, but also to secure laterally adjacent elements 16 and 18 and elements 20 and 22 in edge to edge relationship to one another.

By engaging connecting member 23 to element 16, a triangular space 90 is formed between the outer side 34 of element 16, the extension 30 of element 16 and the outer portion 59 of connecting member 23. Similar triangular spaces will be formed each time an element 12 is engaged to a connecting member 14. The triangular space 90 provides rigidity to the formwork when the structure is filled with concrete and prevents the deformation at the lower parts of the formwork under the effect of the weight of the concrete. The triangular space 90 may also serve as an insulating space for the formwork wall. It is also contemplated by this invention that holes may be added to the outer side 34 of element 16 thereby allowing concrete poured into the formwork to flow into the triangular space 90.

Once one connecting member is slidingly engaged with a first set of four elements, another connecting member can be slid into engagement with the engaging means on the end of the elements opposite the connecting member which is already installed. Thus a wall of formwork is gradually erected. Since the engagement between the connecting members and the elements is a sliding one, the formwork or any given connecting member can be disassembled easily, provided the concrete has not been poured.

As noted above, connecting members 14 are provided with ribs 54. The spaces 55 between the ribs 54 are large enough to ensure a minimum of impedance to the flow of concrete through of the central portion 56. Reinforcing rods can be extended along the lateral length of the wall through the spaces 55 of the central portion 56. The reinforcing rods may in fact be disposed in any orientation within the plane of the concrete wall, with the only limitation being the existence of a linear arrangement of spaces 55 in adjacent members along the pathway to be followed by the reinforcing rod. Thus the rods may be arranged either horizontally or diagonally according to the regularity and spacing of the ribs 54 in adjacent connecting members 14.

It is possible according to the invention to erect only one side or face of the formwork by connecting the connecting members 14 to a plurality of elements 12 but leaving the opposite edge of the connecting members free. With appropriate bracing of the resulting structure it is then possible to install reinforcing rods in the pathways defined by the spaces 55 of successive connecting members. As only one side of the formwork will have been erected, the overall pattern of reinforcing rods is visible from the open side of the formwork allowing an evaluation of the suitability of the reinforcing scheme. Once the reinforcing rods are satisfactorily installed, the complementary side of the formwork may be erected by sliding a plurality of elements 12 into the engaging means on the free edges of the connecting members 14.

Figure 11:
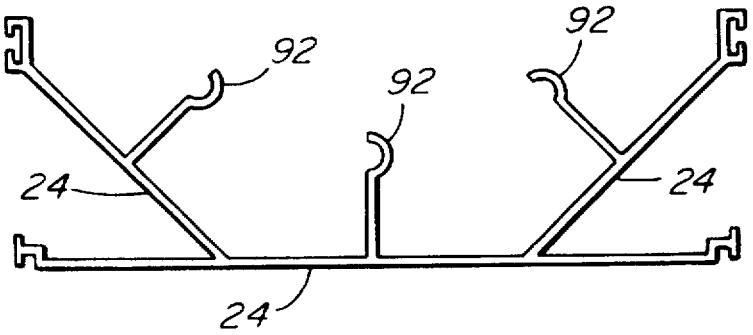
FIG. 11 is an end view of an element with anchors according to one embodiment of the invention.

Anchors 92 may also be provided which project inwardly of the surface 24 of the element 12 as shown in FIG. 11 so as to engage the concrete after it is poured and in order to provide additional rigidity to the structure.

Figure 7:
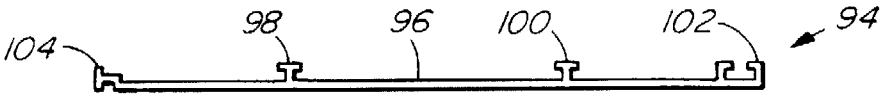
FIG. 7 is an end view of a cornering piece according to the invention.
Figure 8:
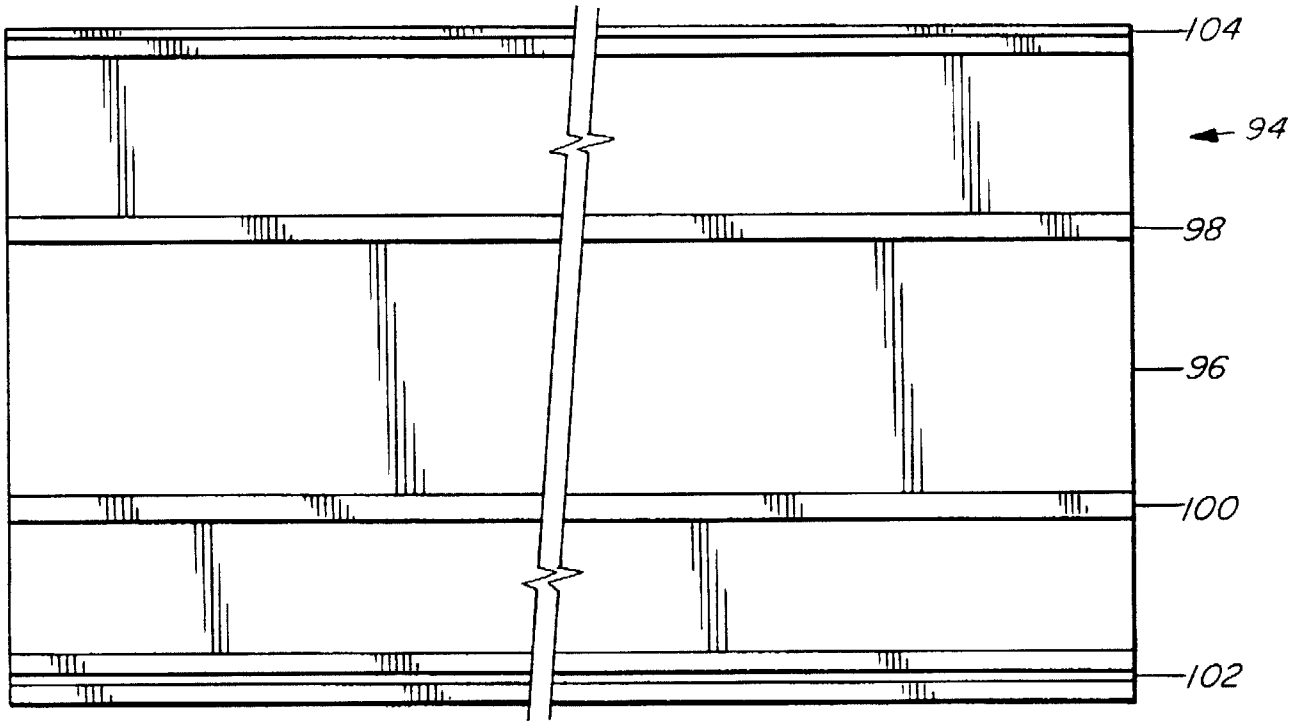
FIG. 8 is a front view of a length of the cornering piece of FIG. 7.

FIGS. 7 and 8 illustrate a cornering piece 94 according to the invention. The cornering piece 94 comprises a substantially planar elongated wall 96. The cornering piece 94 is provided with two central engaging means 98 and 100 and engaging means 102 and 104 at each longitudinal end. The central engaging means 98 and 100 are on one side of the wall 96 and consist of the male portions of a T connector. One of the longitudinal engaging means 102 is on the same side of the wall 96 as the central engaging means 98 and 100 and consists of the female portion of a T connector. The other longitudinal engaging means 104 consists of the male portion of a T connector and faces away from the plane of the cornering piece. Referring to FIG. 1, the coming piece 94 is used negotiate the outer corner of a turn in the formwork wall.

Figure 10:
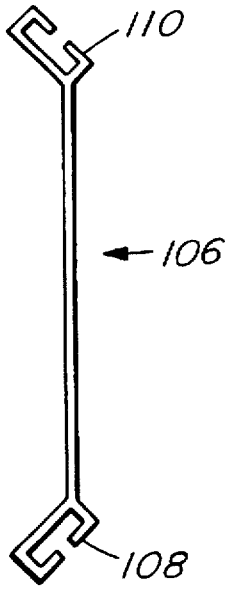
FIG. 10 is an end view of an angle piece according to one embodiment of the invention.

A flat angle piece 106 having angled engaging means 108 and 110 as illustrated in FIG. 10 may be used to negotiate comers and other changes in direction in the wall structure. The engaging means 108 and 110 consists of the female portions of a T connector. Referring to FIG. 1, the angle piece 106 is not only used to negotiate the corner, but also forms a triangular space similar to the one described herein.

Figure 9:
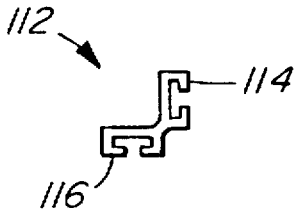
FIG. 9 is an end view of an inside comer finishing piece according to the invention.

FIG. 9 is an end view of an inner comer finishing piece 112 according to the invention. The inner corner finishing piece 112 comprises two engaging means 114 and 116 jointed together at a 90° angle. The engaging means 114 and 116 consists of two female portions of a T connector. Referring to FIG. 1, the inner comer finishing piece 112 is used negotiate the inner corner of a nun in the formwork wall.

Figure 5:
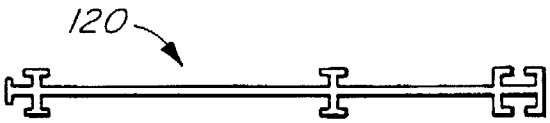
FIG. 5 is an end view of another embodiment of a connecting member according to the invention.
Figure 6:
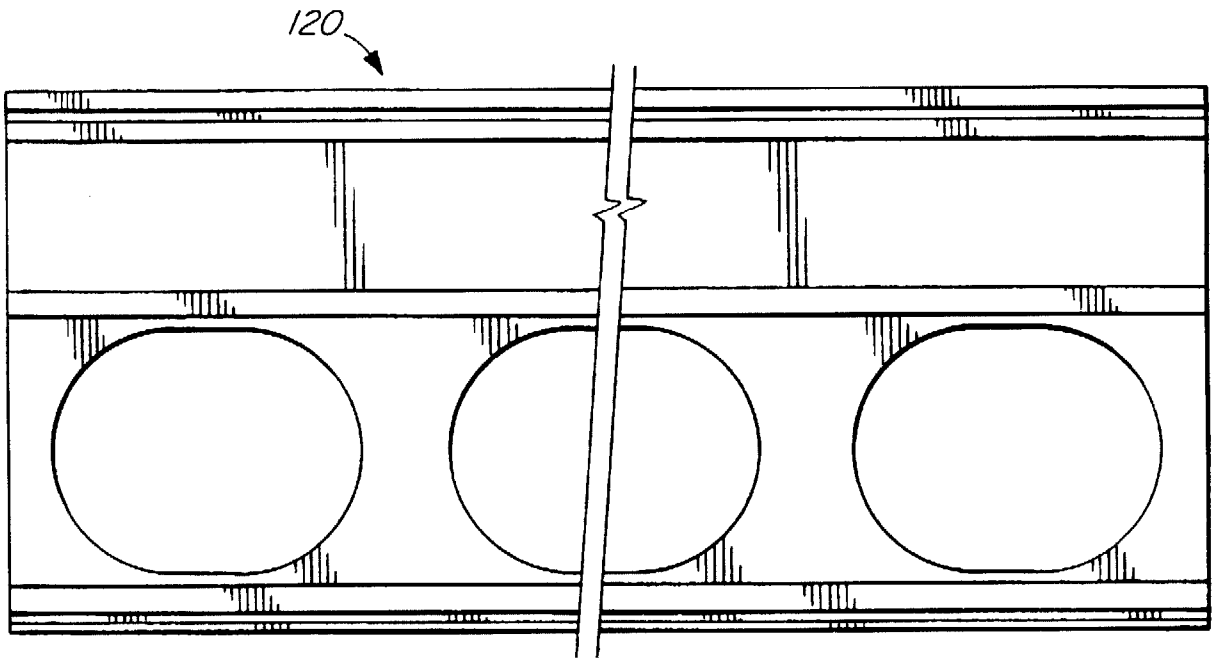
FIG. 6 is a front view of a length of the connecting member of FIG. 5.

It will be appreciated that various complementary components may also be used in association with the components described above but which have not been described in detail. Another embodiment of the element 118 may be created without the extensions and is illustrated in FIG. 1. Another embodiment of the connecting member 120 is illustrated by FIGS. 5 and 6. Referring to FIG. 1, by using the alternative embodiments of the elements 118 and connecting members 120, the formwork has an external appearance of a row of abutting columns.

While the engaging means of the preferred embodiment have been described in some detail, variations on the specific structure of the engaging means may be practiced within the scope of the invention, provided there is a sliding engagement between the cooperating engaging means of the elements and the connecting members to enable the easy erection of the formwork.

It will be appreciated by those skilled in the art that other variations of the preferred embodiment may also be practiced without departing from the scope of the invention.

What is claimed is:

1. A modular formwork assembly for casting concrete to form vertical structures, comprising:

an elongated element having a surface extending from one longitudinal edge of the element to the opposite longitudinal edge of the element so as to define a generally concave cross section, said surface having a generally planar middle portion, and said element further comprising two extensions which extend laterally outward from said middle portion and which are co-planar with said middle portion, wherein the longitudinal edges and the edges of the extensions are provided with means for releasably interconnecting the element with a connecting member, said interconnecting means extending substantially along the length of the element;

an elongated connecting member comprising an elongated wall defined between a first and an opposite longitudinal edges of the member, a central portion defined between a first and an opposite inner longitudinal section lines of the member, two outer portions each of which is defined between a longitudinal edge and an inner longitudinal section line of the member, and wherein each of the longitudinal edges and inner longitudinal section lines of the member is provided with engaging means for engaging said interconnecting means, said engaging means adapted to cooperate in longitudinal sliding engagement with the interconnecting means of each of a pair of said elements when said elements are presented in edge to edge relationship for connection about opposing sides of the interconnecting means of the member;

whereby the connecting member is engaged simultaneously by each of a first pair of said elements presented in edge to edge relationship about one outer portion of the member and each of a second pair of said elements presented in edge to edge relationship about the opposite outer portion of the member.

2. An assembly as in claim 1 wherein said element has inward projections projecting inwardly from said surface whereby to anchor said element to concrete poured into the formwork created by interconnecting a plurality of said elements.

3. An assembly as in claim 1 wherein said element has insulating material on said surface.

4. An assembly as in claim 1 wherein said connecting member has a plurality of ribs extending between said inner longitudinal section lines along the length of said member and being spaced a distance from one another sufficient to enable the flow of concrete through said central portion.

5. An elongated ending piece for use in a modular formwork assembly for casting concrete to form vertical structures, said assembly comprising a plurality of components each having engaging means for interconnecting said components, comprising:

a continuous planar portion defined between a first and an opposite longitudinal edges of the ending piece;

a central portion defined between a first and an opposite inner longitudinal section lines of the ending piece;

two outer portions each of which is defined between a longitudinal edge and an inner longitudinal section line of the ending piece;

a male T-connector on one of said longitudinal edges, a female connector on the other of said longitudinal edges, and a male T-connector along each of said inner longitudinal section lines on a first side of the ending piece, said male T-connectors and said female connector being adapted to cooperate in longitudinal sliding engagement with the engaging means of said components and wherein the longitudinal edges and inner longitudinal section lines on a second side of the ending piece present a flat surface which is substantially continuous with said planar portion.

6. A kit for a modular formwork assembly for casting concrete to form vertical structures, comprising:

an elongated element having a surface extending from one longitudinal edge of the element to the opposite longitudinal edge of the element so as to define a generally concave cross section, said surface having a generally planar middle portion, and said element further comprising two extensions which extend laterally outward from said middle portion and which are co-planar with said middle portion, wherein the longitudinal edges and the edges of the extensions are provided with means for releasably interconnecting the element with a connecting member, said interconnecting means extending substantially along the length of the element;

an elongated connecting member comprising an elongated wall defined between a first and an opposite longitudinal edges of the member, a central portion defined between a first and an opposite inner longitudinal section lines of the member, two outer portions each of which is defined between a longitudinal edge and an inner longitudinal section line of the member, and wherein each of the longitudinal edges and inner longitudinal section lines of the member is provided with means for engaging said interconnecting means, said engaging means adapted to cooperate in longitudinal sliding engagement with the interconnecting means of each of a pair of said elements when said elements are presented in edge to edge relationship for connection about opposing sides of the interconnecting means of the member;

whereby the connecting member is adapted to engage simultaneously each of a first pair of said elements presented in edge to edge relationship about one outer portion of the member and each of a second pair of said elements presented in edge to edge relationship about the opposite outer portion of the member.

7. A kit according to claim 6 wherein said element has inward projections projecting inwardly from said surface to anchor said element to concrete poured into the formwork created by interconnecting a plurality of said elements.

8. A kit according to claim 6 wherein said element has insulating material on said surface.

9. A kit according to claim 6 wherein said connecting member has a plurality of ribs extending between said inner longitudinal section lines along the length of said member and being spaced a distance from one another sufficient to enable the flow of concrete through said central portion.

* * * * *